US010126091B2

(12) United States Patent
Wendelburg

(10) Patent No.: US 10,126,091 B2
(45) Date of Patent: Nov. 13, 2018

(54) ZERO TORQUE RISER

(71) Applicant: Kirk L. Wendelburg, Los Angeles, CA (US)

(72) Inventor: Kirk L. Wendelburg, Los Angeles, CA (US)

( * ) Notice: Subject to any disclaimer, the term of this patent is extended or adjusted under 35 U.S.C. 154(b) by 0 days.

(21) Appl. No.: 15/657,979

(22) Filed: Jul. 24, 2017

(65) Prior Publication Data

US 2018/0031348 A1 Feb. 1, 2018

Related U.S. Application Data

(60) Provisional application No. 62/367,008, filed on Jul. 26, 2016.

(51) Int. Cl.

| | |
|---|---|
| ***F41B 5/00*** | (2006.01) |
| ***F41B 5/14*** | (2006.01) |
| ***F41B 5/10*** | (2006.01) |

(52) U.S. Cl.

CPC ..... *F41B 5/1426* (2013.01); *F41B 5/10* (2013.01); *F41B 5/14* (2013.01); *F41B 5/1403* (2013.01)

(58) Field of Classification Search

CPC ..... F41B 5/00; F41B 5/10; F41B 5/14

See application file for complete search history.

(56) References Cited

U.S. PATENT DOCUMENTS

| | | | | | |
|---|---|---|---|---|---|
| 3,397,685 | A * | 8/1968 | Walker | F41B 5/0005 | 124/23.1 |
| 3,407,799 | A * | 10/1968 | Bennett | F41B 5/0005 | 123/47 R |
| 3,538,902 | A * | 11/1970 | Fowkes | F41B 5/0031 | 124/23.1 |
| 4,457,287 | A * | 7/1984 | Babington | F41B 5/10 | 124/23.1 |
| 5,842,460 | A * | 12/1998 | Barber | F41B 5/14 | 124/88 |
| 8,079,353 | B2 * | 12/2011 | Davis | F41B 5/0026 | 124/23.1 |
| 2016/0102937 | A1 * | 4/2016 | Ell | F41B 5/1403 | 124/25.6 |

* cited by examiner

*Primary Examiner* — John Ricci

(74) *Attorney, Agent, or Firm* — Kelly & Kelley, LLP

(57) ABSTRACT

A zero torque riser for an archery bow that provides an hemispherical pivoting connection between a hand grip and a riser body by using a ball and socket connection. A spherical head is variably mounted in a spherical socket on a hand grip. The spherical head is mounted on a variable position peg on the riser body.

19 Claims, 13 Drawing Sheets

ZERO TORQUE RISER

RELATED APPLICATIONS

This application claims the benefit of U.S. Provisional Application No. 62/367,008, filed on Jul. 26, 2016.

BACKGROUND OF THE INVENTION

The present invention generally relates to archery equipment, particularly compound and/or recurve bows. More specifically, the present invention relates to an improved grip section of the riser for any compound or recurve bow so as to eliminate or diminish the undesirable effects of hand torque.

It is well known in the field of competitive archery that shot accuracy has many independent variables. One important variable is the ability to minimize hand torque or movement during the shot. All movement through the hand is transferred into the grip section of the bow. The translation and torsion of the hand is transferred into the 4" to 6" grip section of the riser. The resulting moment arm of the riser grip further transfers any micro motion into the bow, bowstring and arrow rest to further adversely affect the shot of the arrow. Decreasing the effects of hand torque and hand placement on the grip as it translates into the shot of the arrow can potentially have a profound increase in accuracy of the bow.

Accordingly, there is a need for an improved grip on a riser for compound and/or recurve bows to minimize the effects of placement of the hand and the transfer of hand movements and torque to the riser. The present invention fulfills these needs and provides other related advantages, such as the ability to transform the riser from a deflex design, to a neutral, to a reflex design riser conformation as it pertains to the grip in relationship to the limb pockets. It also has the ability to manipulate the power stroke of the bow, thereby tremendously increasing speed and accuracy.

SUMMARY OF THE INVENTION

The inventor has developed an improved grip by comparing the forces involved in such hand torque and movement to the design of joints in a vertebrate skeleton. The ability to move the arms and legs of such a skeleton without a transfer of torsional forces into the torso is because of a ball and socket joint. Utilizing similar structures as a ball and socket joint, one can minimize the moment arm of the grip that then transfers undesirable torque and hand movement into the bow. To achieve these results, the amount of contact area between the hand grip and riser has to be reduced to a minimal amount. By reducing the contact area to a "point contact" between the ball and socket of the grip and the connection to the riser, inadvertent changes in hand pressure or position are no longer transferred to the bow riser and will no longer affect the shot of the arrow. Hand position on the grip design becomes less important in determining accuracy. This reduction in contact area can be accomplished by simulating a ball and socket joint.

The present invention is directed to a zero torque riser for an archery bow. The zero torque riser has a riser body with a forward riser beam disposed on an anterior portion of the riser body. A mounting peg is attached to a posterior surface of the forward riser beam. A hand grip is attached to the mounting peg in a manner that allows for hemispherical pivoting relative to the riser body.

The riser body may have an upper riser portion extending above the forward riser beam, an arrow shelf disposed between the forward riser beam and the upper riser portion, a lower riser portion extending below the forward riser beam, and a rear riser beam spanning from the lower riser portion to the upper riser portion. The riser body may also have multiple lateral bridge supports spanning from the lower riser portion to the upper riser portion or the arrow shelf. In addition, the riser body might have a sight window bridge support spanning from the arrow shelf to an upper end of the upper riser portion.

The hemispherical pivoting attachment of the hand grip to the mounting peg preferably includes a spherical head securely connected to the mounting peg and rotatably mounted in a spherical socket on an anterior surface of the hand grip. The mounting peg preferably has a tapered stem and the spherical head preferably has a tapered port that is configured to receive and securely connect to the tapered stem.

The spherical socket is preferably formed by an upper cap and a lower cap surrounding the spherical head within an anterior channel on the hand grip, wherein the upper cap and lower cap are secured within the anterior channel. The upper cap and lower cap may be securely mounted on a base plate that is secured to the anterior surface of the hand grip.

The hemispherical pivoting attachment might also include a pivoting ball mount consisting of an elongated central stem having the spherical head attached to one end and a base attached to an opposite end. In this configuration, the base preferably includes the tapered port configured to receive and securely connect to the tapered stem on the mounting peg.

The forward riser beam may include a plurality of mounting holes, to which an adjustable clamp is configured to adjustably attach for securing the mounting peg to the forward riser beam by one or more of the plurality of mounting holes. One or more vibration pads may be disposed between the forward riser beam, the mounting peg, and the adjustable clamp.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

The present invention relates to a new riser designed to eliminate or significantly diminish the effects of hand torque in archery. The invention is directed to the grip section of the riser as it transfers unwanted forces to the riser and bow. The design physically spaces the grip or handle section of the riser from the main section of the riser through a ball and socket joint or similarly hemispherical pivoting connection. In the context of this disclosure, the term "hemispherical pivoting" means rotating and pivoting around a hemisphere of the ball joint, limited only by the presence of a stem or neck extending out of the socket.

Figure 1:
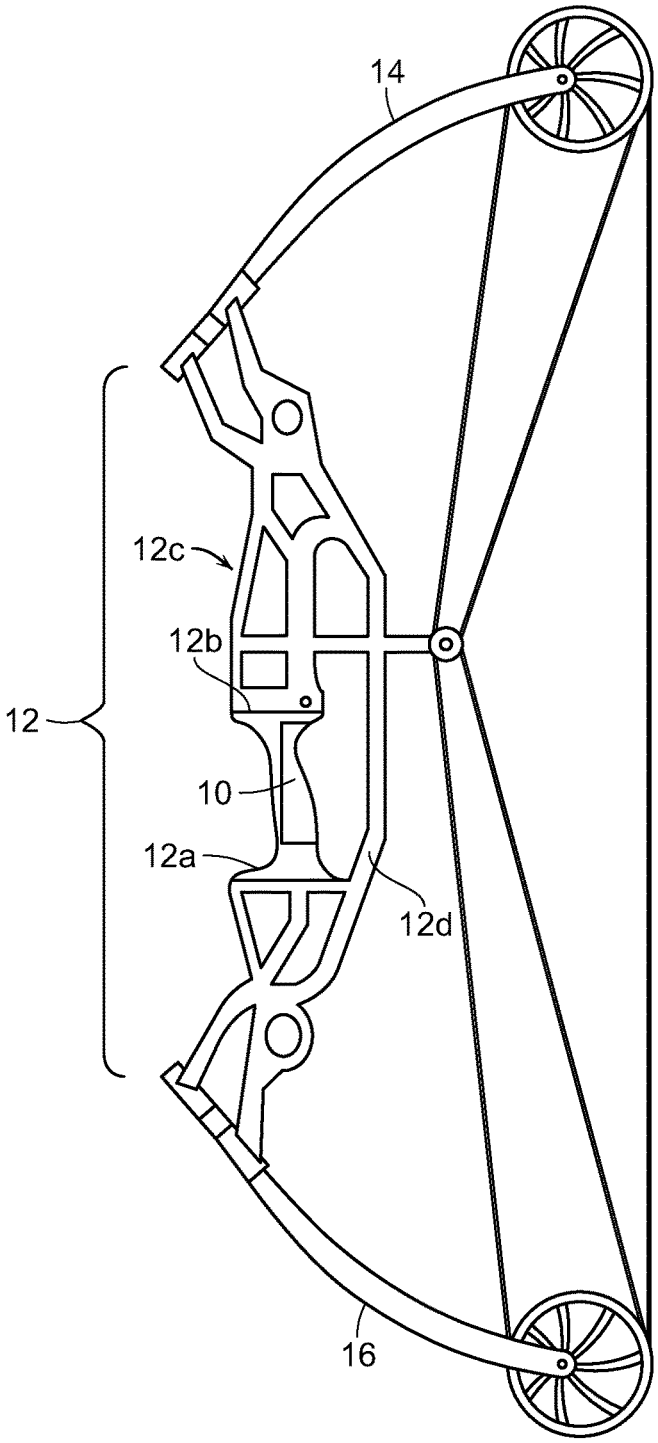
FIG. 1 PRIOR ART
FIG. 1 is an illustration of a prior art compound bow with the grip integrated with the riser.
Figure 2:
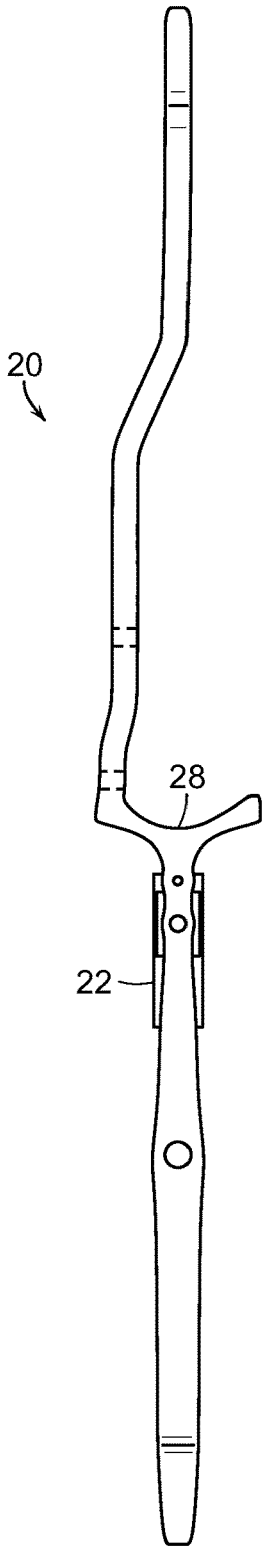
FIG. 2 is front view of a compound bow according to a first embodiment having the grip mounted in a zero torque riser according to the present invention.
Figure 3:
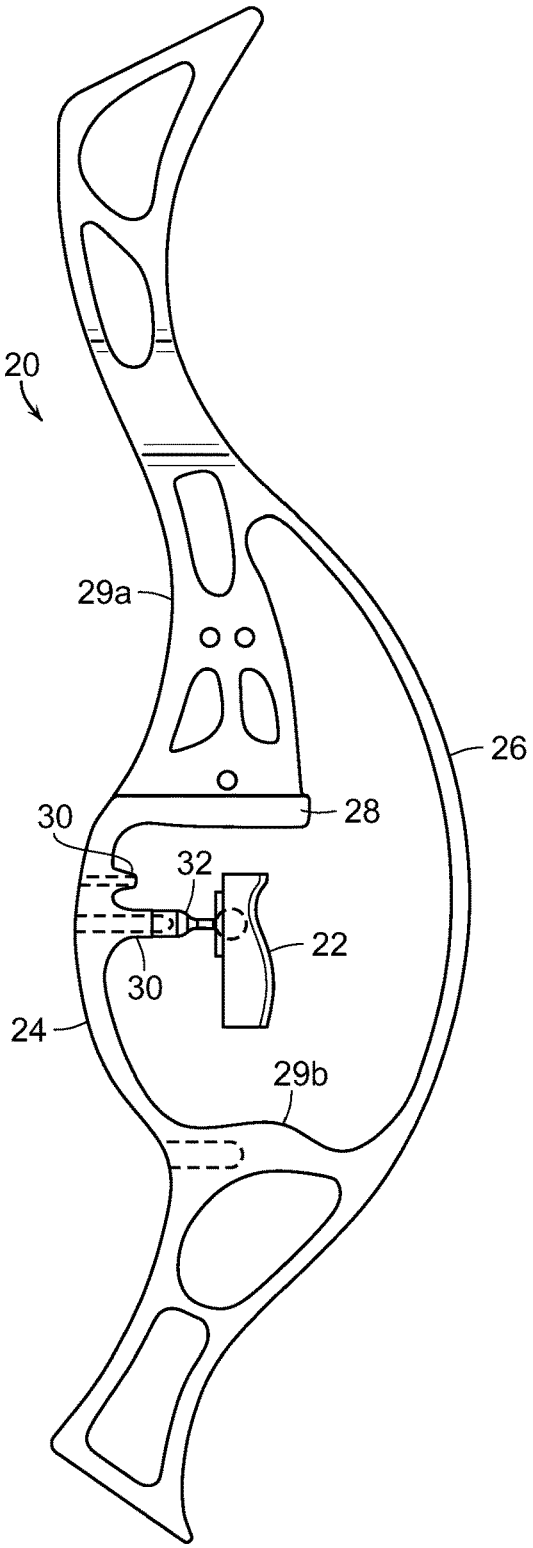
FIG. 3 is side view of a compound bow according to the first embodiment having the grip mounted in a zero torque riser according to the present invention.
Figure 4:
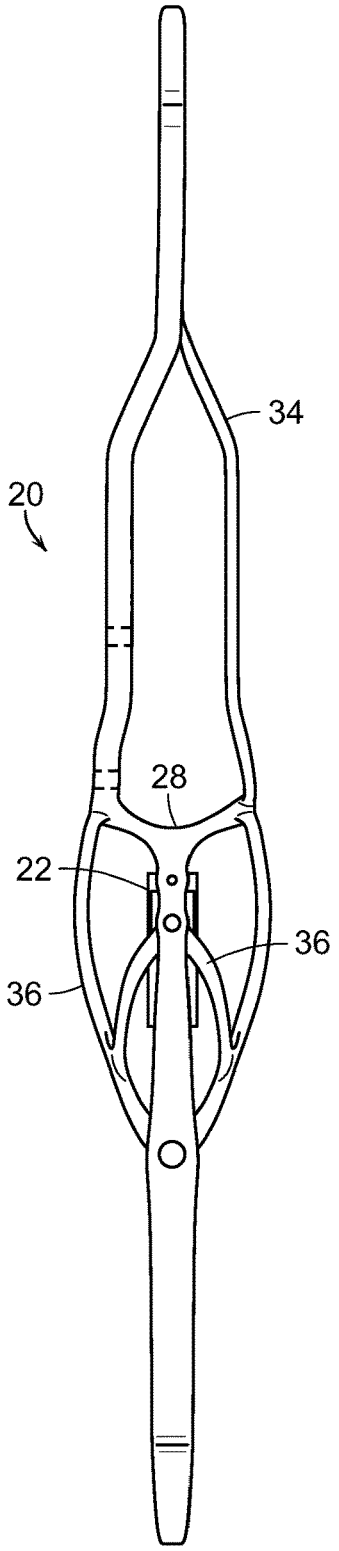
FIG. 4 is front view of a compound bow according to a second embodiment having the grip mounted in a zero torque riser according to the present invention.
Figure 5:
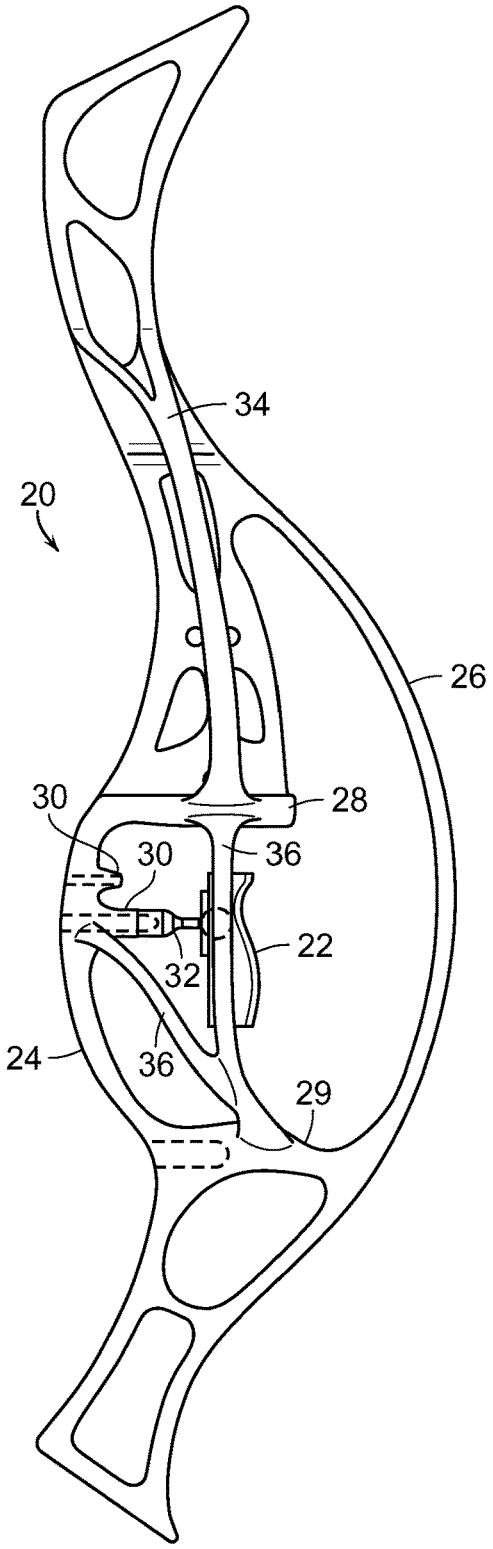
FIG. 5 is side view of a compound bow according to the second embodiment having the grip mounted in a zero torque riser according to the present invention.
Figure 6:
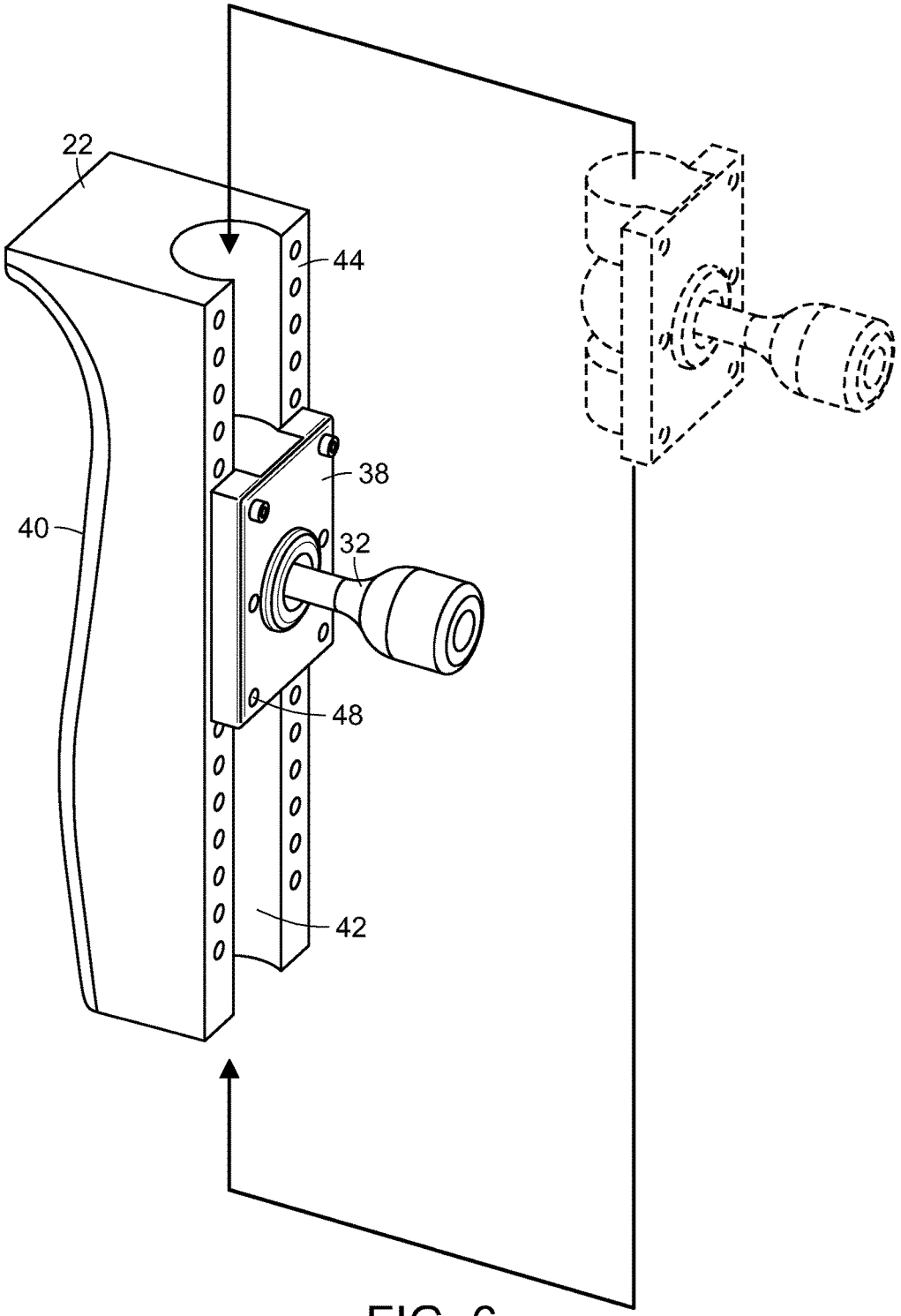
FIG. 6 is a front oblique view illustrating the grip mounted on a sliding retainer engaging a pivoting ball mount.
Figure 7:
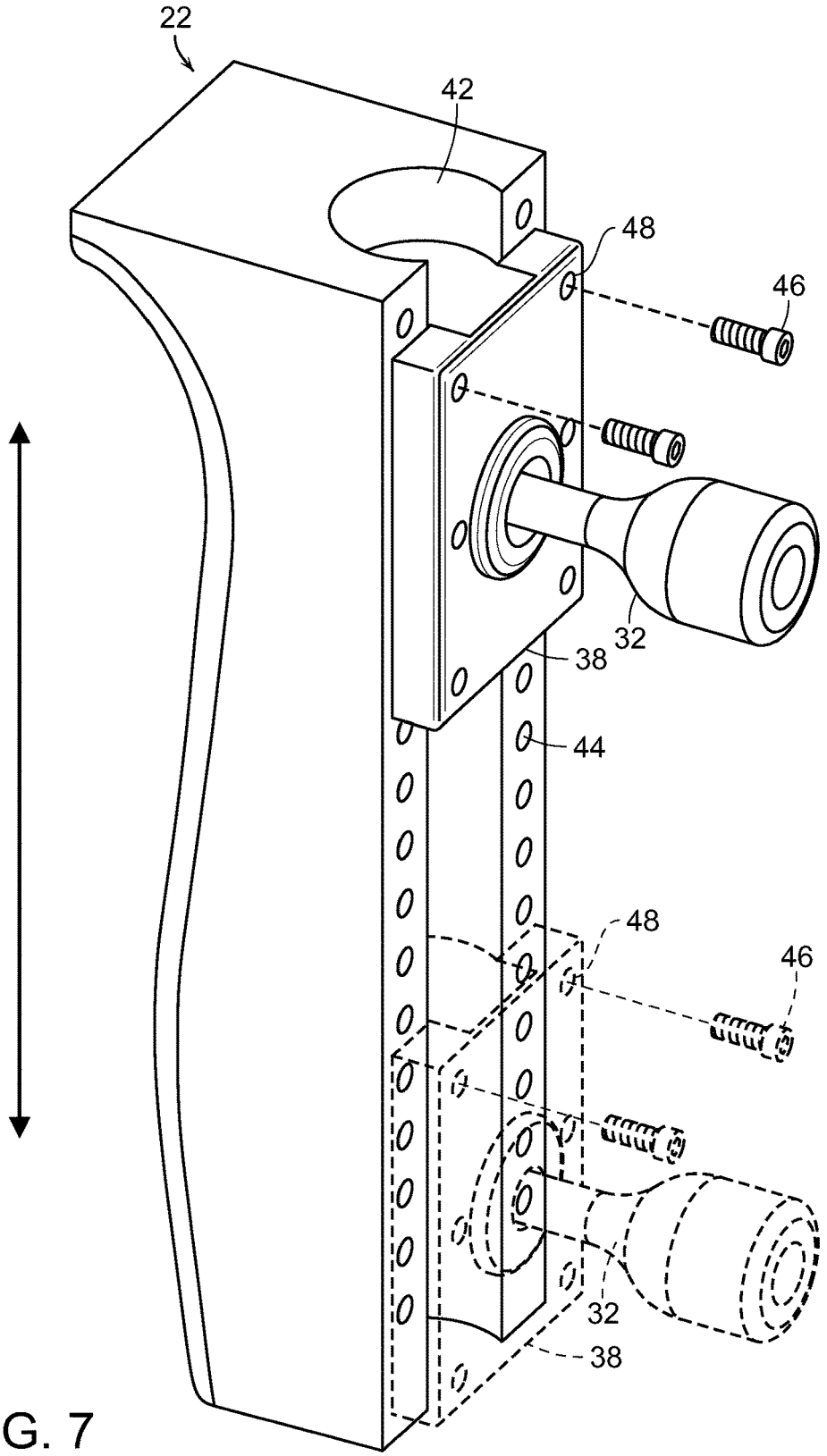
FIG. 7 is a close-up front oblique view illustrating the variable positioning of the grip on the sliding retainer and pivoting ball mount.
Figure 8:
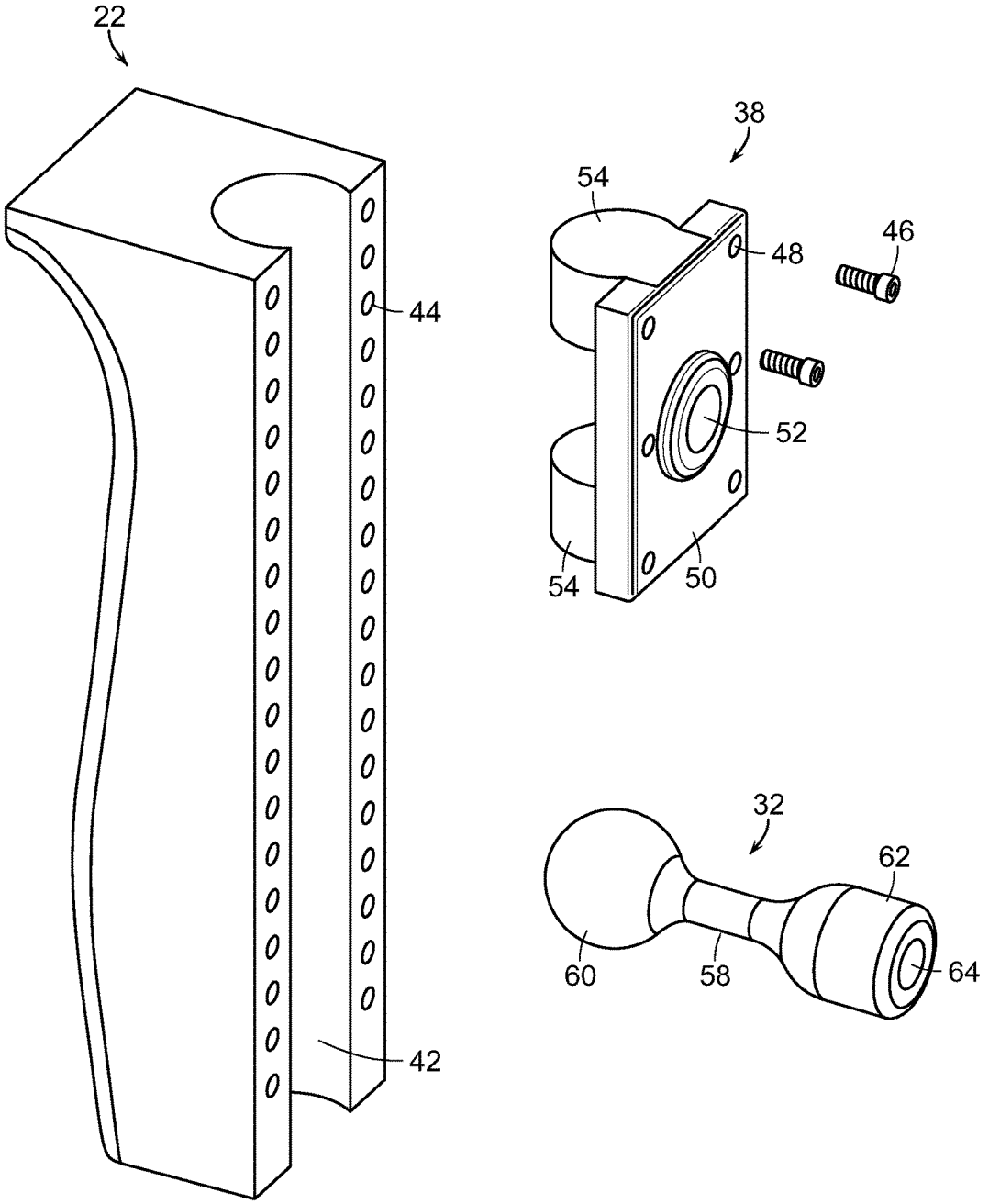
FIG. 8 is an illustration of the separate components of the grip, sliding retainer, and pivoting ball mount.

As illustrated in FIG. 1, prior art bows generally have the grip 10 fixed mounted to the riser 12 so that any hand movement or pressure variation into the grip 10 translates directly to the riser 12. Given the elongated nature of the riser 12, any movement of the grip 10 would transfer into a greater movement of the extremities of the bow, e.g., upper and lower limbs 14, 16. Such greater movement of the limbs 14, 16 would decrease the accuracy of any shot with the bow if a user cannot remain perfectly still and maintain the same hand position and pressure. Typically, a riser 12 can be a single main beam 12*a* or split into a main beam 12*a* with a rear bridge support beam 12*d* along with several support trusses between the beams. The main beam 12*a* follows the centerline of the bow from the arrow shelf 12*b* continuing downward to the area of limb 16 attachment. The main beam 12*a* upward through the sight window 12*c* and rear beam 12*d* are offset to provide a center shot for clearance of the arrow and vanes.

As shown in FIGS. 2-5, the present invention is directed to a design of a riser body 20 for a compound bow. The design facilitates the mounting of the hand grip 22 on a forward riser beam 24 and below the arrow shelf 28. The riser body 20 preferably has an upper riser portion 29*a* and a lower riser portion 29*b*, to which the limbs 14, 16 are respectively attached (although not shown in these views. The riser body 20 might also include a rear riser beam 26 for added structural support. The main beam 12*a* and grip 10 of the prior art are eliminated in favor of the inventive zero torque riser.

In a first preferred embodiment of the invention (FIGS. 2 and 3), one or more tapered mounting pegs 30 project rearward from a posterior surface of the forward riser beam 24. The peg 30 may be provided in multiple variations for flexibility in attachment as described below. A pivoting, variable length neck ball mount 32 may be attached to the peg 30 and the grip 22 mounted on the pivoting ball mount 32. In this way, the hand grip 22 is rotationally and pivotably mounted with point contact onto the forward riser 24. This point contact reduces the probability of transferring any movement of the hand grip 22 to the riser body 20 during an archery shot.

A second preferred embodiment of the invention (FIGS. 4 and 5) has a similar construction as the first preferred embodiment with the addition of a sight window bridge 34 and lower lateral bridge supports 36 surrounding the grip 22. The upper sight window bridge 34 and lower lateral bridge supports 36 are intended to provide additional overall structural support for the riser body 20 due to the extreme forces transferred through a compound bow, particularly if the rear riser beam 26 is not included. These additional bridges can be used separately or in combination to provide additional rigidity and support.

Figure 9:
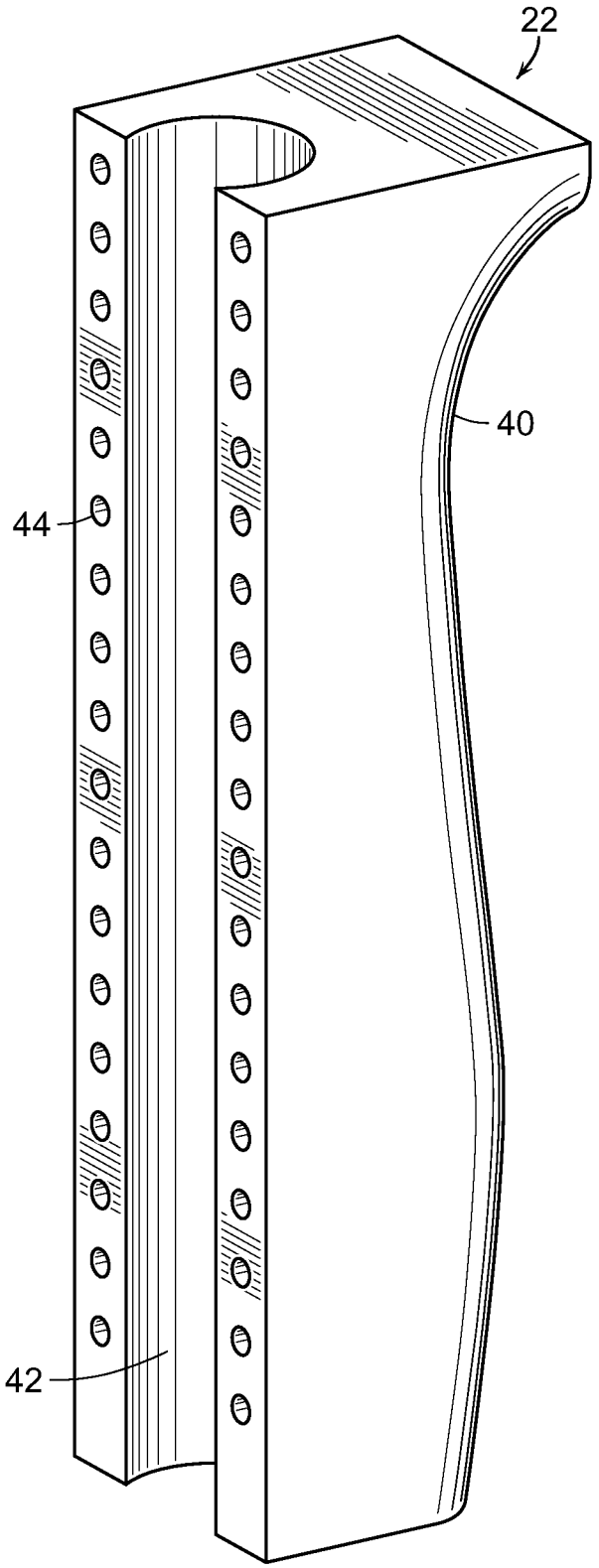
FIG. 9 is a close-up alternate perspective view of the grip.

FIGS. 6-11 illustrate the grip 22, the pivoting ball mount 32, and a sliding retainer 38, in more detail. Each of these components work together to secure the grip 22 to the peg 30 and provide the zero torque function in the nature of the hemispherical pivoting. As shown in FIG. 9, the grip 22 has a contact portion 40 on a posterior surface of the hand grip 22 that is configured to receive the palm or other portion of a user's hand. The contact portion 40 has the normal contour of a conventional narrow to wide throated grip and can be made in the low, medium and high wrist positions. The grip 22 can be interchanged between any compound or recurve bow with a similar riser design. While only a few styles of hand grip 22 are illustrated, the zero torque riser 20 will operate with any style of grip, including but not limited to, conventional high to low grips, flat grips, pear-shaped grips, and round or ball-shaped grips.

Opposite the contact portion 40, on an anterior surface of the hand grip 22, is a sliding channel 42 that is configured to receive the sliding retainer 38 and pivoting ball mount 32 as described below. The sliding retainer 38 may enter the sliding channel 42 through either the top or bottom. The sliding channel 42 has a generally cylindrical cross-sectional shape that, in a particularly preferred embodiment, encompasses the spherical head 60 of the pivoting ball mount 32 to approximately 200 degrees or more of a spherical rotation. The object is that sliding channel 42 encloses enough of the spherical head 60 such that it cannot be removed from the sliding channel 42 other than by sliding out of either the top or bottom. The forward face of the sliding channel 42 may be open the remaining 160 degrees or less.

The ball and neck components of the pivoting ball mount 32 along with the retainer 38 are engaged into the sliding channel 42 of the grip 22 from the bottom or top and can be positioned at 5 mm increments over the entire length of the grip as described below. The retainer 38 has upper and lower stops 54 that internally conform to the spherical head 60 preventing vertical movement of the pivoting ball mount 32 within the sliding channel 42. The configuration allows for selective movement and then containment of the pivoting ball mount vertically along the sliding channel 42 in approximately 5 mm increments.

The sliding channel 42 includes a securing mechanism to retain the sliding retainer 38 in a selected position. Without the securing mechanism, the sliding retainer 38 is free to slide up and down in the sliding channel 42. In a preferred embodiment, the securing mechanism consists of a plurality of screw holes 44 along either or both sides of the sliding channel 42. The screw holes 44 are configured to receive threaded screws 46 or similar devices passed through openings 48 on the sliding retainer 38. The screws 46 may engage one or more openings 48 and holes 44 to secure the sliding retainer 38 to the sliding channel 42. In a particularly preferred embodiment, the screw holes 44 have a size of about 2 mm and are preferably spaced approximately 5 mm apart to allow for the securing of the sliding retainer 38 in various positions along the length of the sliding channel 42 as described above.

Figure 10:
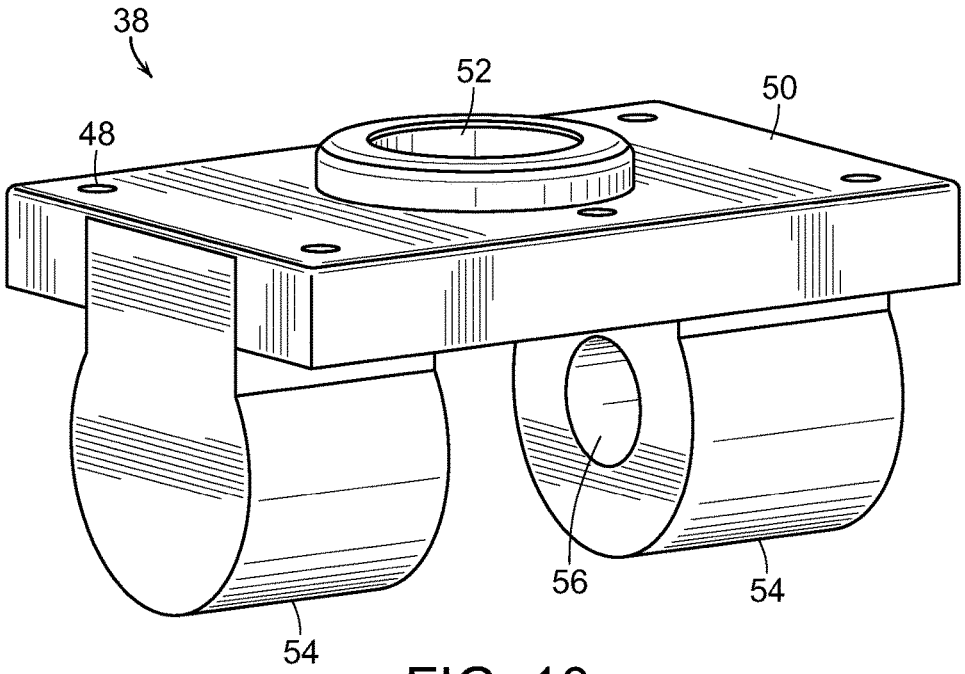
FIG. 10 is a close-up view of the sliding retainer.

As shown in FIG. 10, the sliding retainer 38 has a base plate 50 with a central port 52. A pair of semi-circular caps 54 (or stops as described above) extend from the base plate 50 on either side of the port 52. The openings 48 pass through the base plate 50 along opposite side edges thereof. The caps 54 have a semi-circular shape that is configured to match the cross-sectional shape of the sliding channel 42. The caps 54 each also include a recess 56 that faces the port 52. These recesses 56 are configured to receive the spherical head 60 that is on one end of the pivoting ball mount 32.

Figure 11:
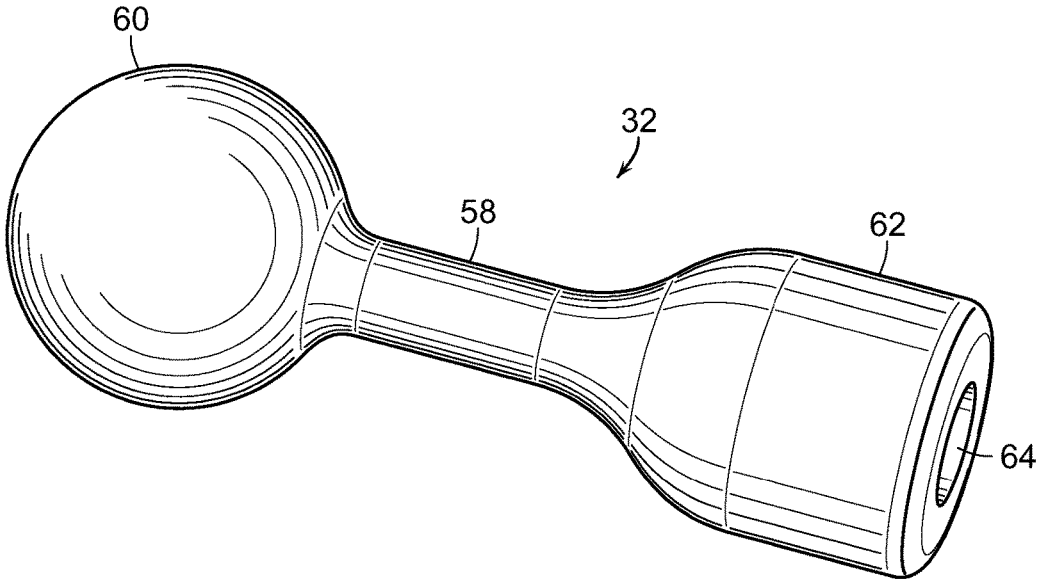
FIG. 11 is a close-up view of the pivoting ball mount.

As shown in FIG. 11, the pivoting ball mount 32 consists of a central stem 58 that has a spherical head 60 on one end and a base 62 on the other end. The base 62 is preferably cylindrical and is sized and configured so as to pass through the port 52 in the base plate 50 of the sliding retainer 38. In contrast, the spherical head 60 has a diameter that will prevent it from passing through the port 52. The diameter of the spherical head 60 is such that it closely matches the cross-sectional shape of the caps 54 and the sliding channel 42. As discussed above, the spherical head 60 rests in the recesses 56 on the caps 54 of the sliding retainer 38. This configuration of the caps 54 and recesses 56 creates a spherical socket within the sliding channel 42. The central stem 58 may be made in variable lengths to allow for a neutral, deflex or reflex positions of the grip simply by changing one component. The variability also provides changes in the power stroke of the bow to increase the speed in the more reflex position.

The cylindrical base 62 has a female mounting port 64 opposite the spherical head 60. This mounting port 64 is configured to match the pegs 30 on the front riser 24. The pegs 30 are constructed as the male mate of a Morris taper which allows for a cold metal weld when a mating opening is tapped (lightly impacted) over it. The multiple stems 30 provide modularity to the design. The mounting port 64 is impacted onto the end of one of the pegs 30 which creates a secure metal to metal bond. The cylindrical base 62 is preferably passed through the port 52 on the base plate 50 of the sliding retainer 38 before the mounting port 64 is impacted onto one of the pegs 30.

In a particularly preferred embodiment, at least one of the pegs 30 has an initial diameter at the riser of approximately 10 mm. As the peg 30 extends away from the riser 24 to a distance of about 10 mm, the diameter of the peg 30 gradually tapers at an angle of approximately 10 to 15 degrees until it ends. The pivoting ball mount 32 may vary in length from 2 cm to 5 cm in approximately 1 cm increments to allow for variability in the grip position, power stroke, or draw length of the bow. Preferably, the spherical head 60 is polished metal ball that matches the diameter of the sliding channel 42, e.g., approximately 15 mm.

The port 52 may have a diameter that is slightly larger than the diameter of the cylindrical base 62—approximately 1 millimeter. The port 52 and base plate 50 will act as a containment device for rotation and tipping of the grip 22 around the spherical head 60. The size of the port 52 and thickness of the base plate 50 can vary according to the desired range of motion. A thicker base plate 50, or smaller port 52, will decrease the tipping range of motion with the grip as the shaft 58 contacts the walls of the port 52.

Due to the ability to mount the grip 22 onto the pivoting ball mount 32 in a variety of vertical locations, the grip 22 can function as a high wrist grip with a high ball mount position, and as a low wrist grip with the ball mounted in a low position. Also because of the ball and socket design, the hand placement can be vertical or angled to any degree to accommodate the style of the archer.

Figure 12:
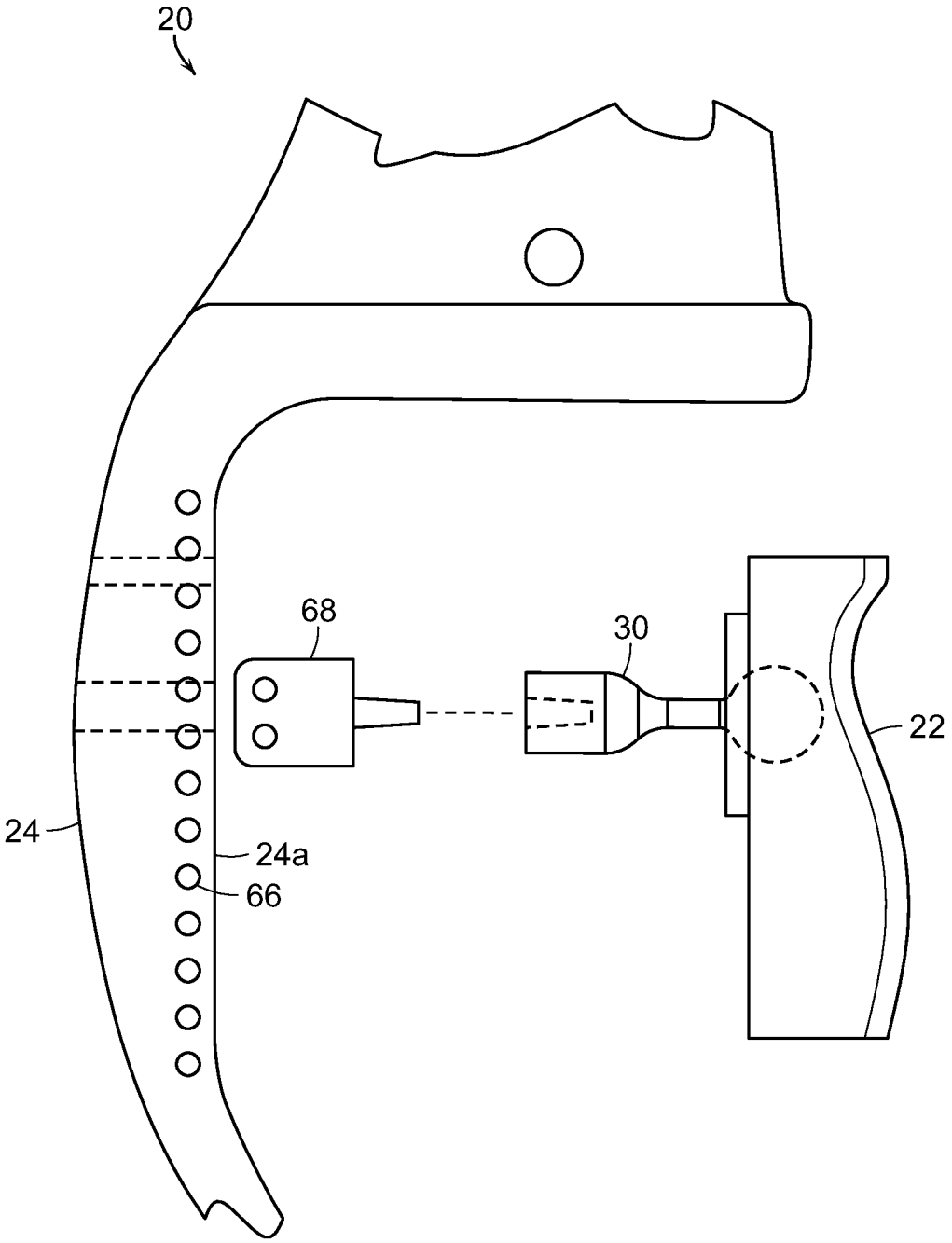
FIG. 12 illustrates a close up view of the forward riser in an alternate embodiment of the inventive bow which allows for multi-positioning of the peg on the front bridge of the riser.
Figure 13:
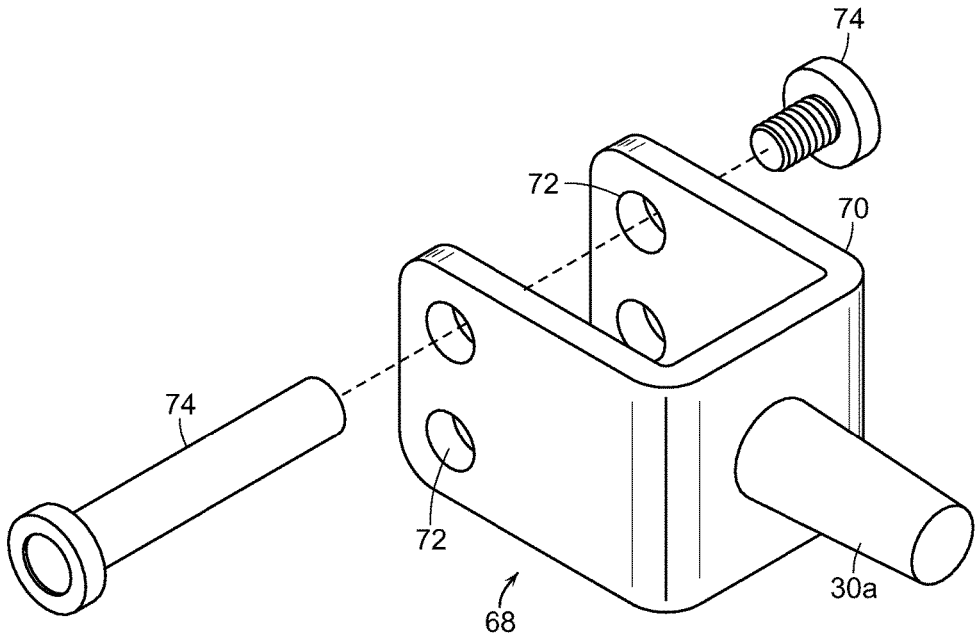
FIG. 13 illustrates a perspective view of an adjustment clamp of the alternate embodiment.

FIGS. 12 and 13 illustrate an alternate embodiment of the inventive zero torque riser 20. In this embodiment, the forward riser 24 includes a plurality of adjustment points 66 arrayed vertically. A clamp 68 with the male end of the Morris taper, peg 30*a*, is configured to adjustably engage the plurality of points 66 along the vertical riser 24*a*. The clamp 68 has a U-shaped body 70 configured to fit around a portion of the vertical riser 24*a* adjacent to the plurality of points 66. The clamp 68 also has matching pairs of set points 72 on the body 70 that are configured to receive pins 74 or other securing mechanisms in conjunction with the plurality of adjustment points 66. In this way, the clamp 68 can be adjustably attached to the forward riser 24. The body 70 also has a peg 30*a* configured to receive the mounting port 64 on a ball mount 32. By configuring the ball mount 32, sliding retainer 38, and grip 22 as described above, one can mount the grip 22 as a point contact, zero torque riser. The adjustability of the body 70 on the forward riser 24 allows one to more easily mount the grip 22 in a low, middle, or high position for precise tuning of the bow.

Figure 14:
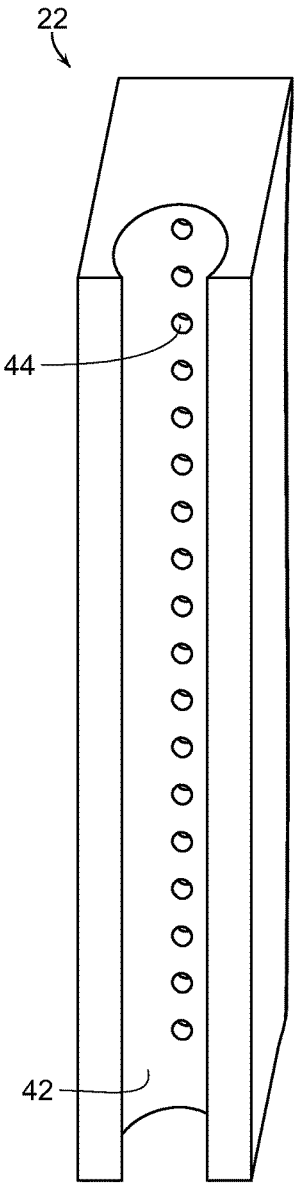
FIG. 14 illustrates an alternate embodiment of the hand grip and anterior channel therein.
Figure 15:
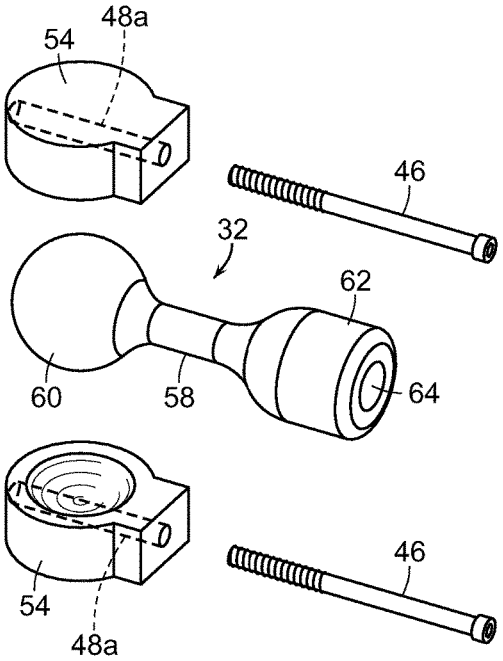
FIG. 15 illustrates an alternate embodiment of the mechanism for securing the spherical head within the anterior channel.
Figure 16:
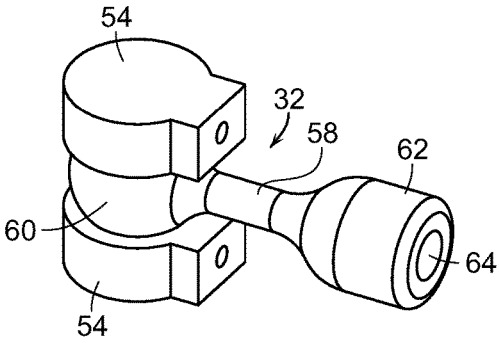
FIG. 16 further illustrates the alternate embodiment of the mechanism for securing the spherical head within the anterior channel.

FIGS. 14-16 illustrate another alternate embodiment, wherein the plurality of screw holes 44 is disposed in the bottom of the sliding channel 42. Rather than using a sliding retainer 38 as discussed above, this alternate embodiment relies upon a pair of upper and lower caps 54 without a connecting base plate 50. The upper and lower caps 54 still surround the spherical head 60 and still slide into the channel 42 from the top or bottom. However, the upper and lower caps are secured into the sliding channel 42 by a threaded screw 46 that passes through an opening 48*a* and into the plurality of screw holes 44 in the bottom of the sliding channel 42. Except for these changes in how the caps 54 are secured in the sliding channel 42, this alternate embodiment functions in the same hemispherical pivoting manner described above.

Figure 17:
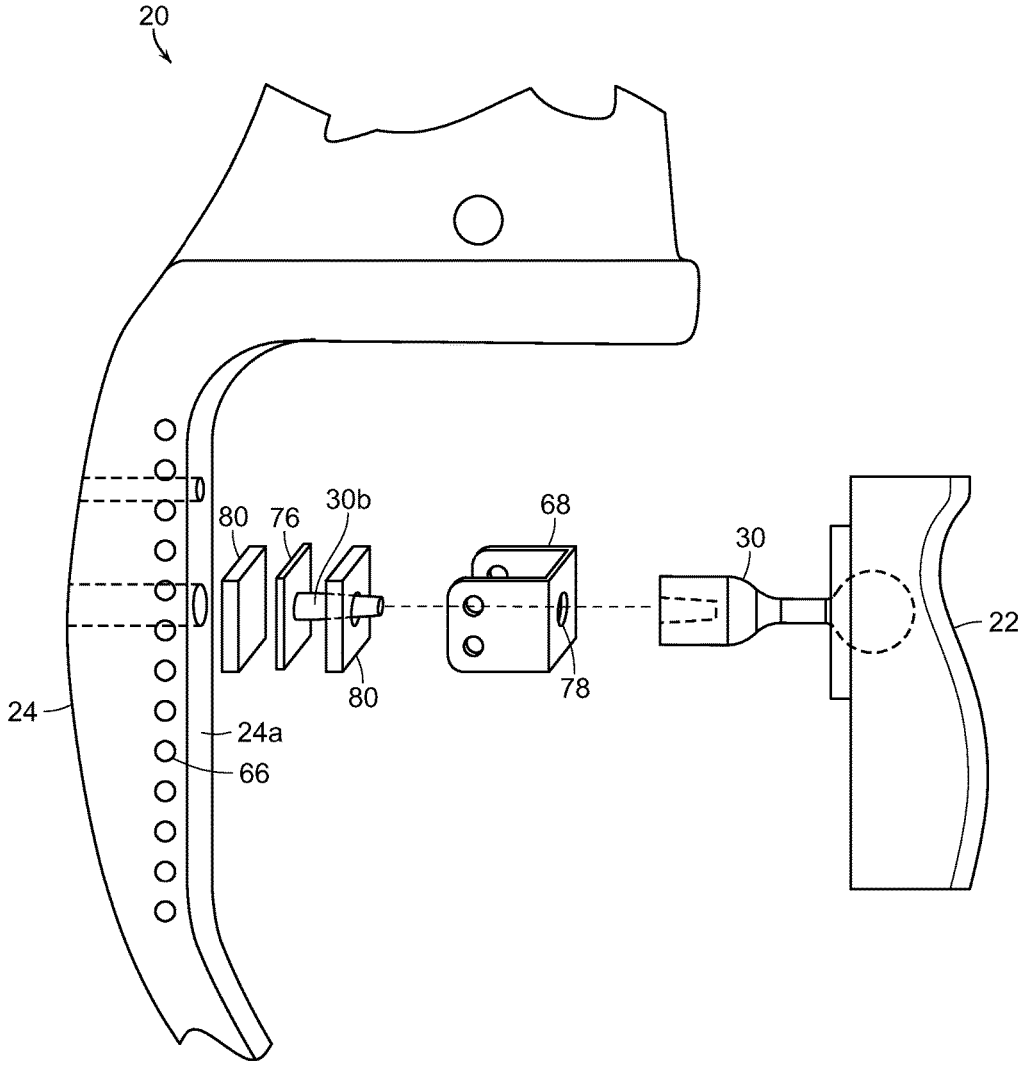
FIG. 17 illustrates an alternate embodiment for securing the mounting peg to the forward riser beam.

FIG. 17 illustrates and alternate embodiment for how the mounting peg 30 is attached to the forward riser 24. In this embodiment, mounting peg 30*b* is mounted on a securing plate 76. The clamp 68 for securing the mounting peg 30*b* to the forward riser 24 includes an opening 78 through which the mounting peg 30*b* is configured to pass. The securing plate 76 is secured within the U-shape of the clamp 68. When the clamp 68 is secured to the vertical riser 24*a* as described above, the securing plate 76 and mounting peg 30*b* are likewise secured. This embodiment may also include vibration pads 80 disposed between the vertical riser 24 and the securing plate 76, between the securing plate 76 and the clamp 68, or both. The vibration pads 80 are preferably a foam, rubber, or similarly elastically resilient material to absorb shock or vibration created by use of the bow.

Figure 18:
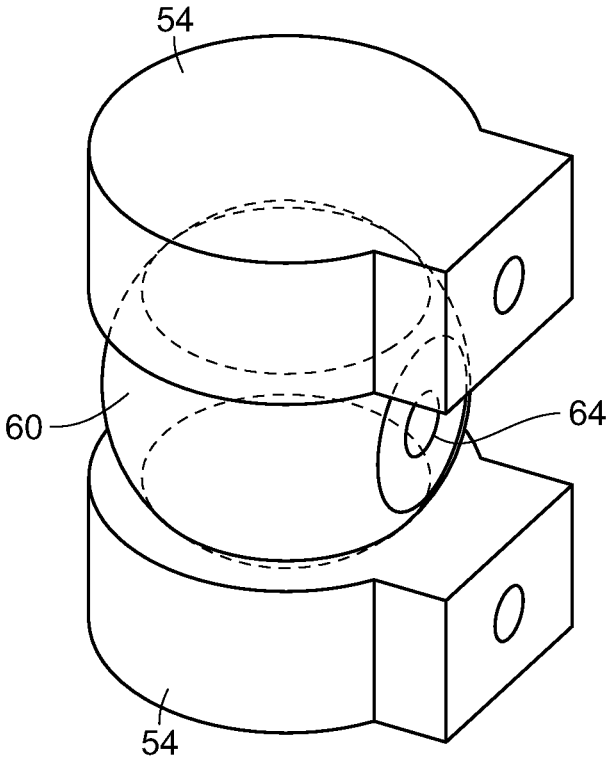
FIG. 18 illustrates an alternate embodiment for the spherical head.

FIG. 18 illustrates an alternate embodiment of the spherical head 60. In this embodiment, the spherical head 60 is presented without the rest of the pivoting ball mount 32. The central stem 58 and cylindrical base 62 are eliminated with the mounting port 64 being disposed directly in the spherical head 60. This embodiment of the spherical head 60 is mounted in the sliding channel in a manner similar that described above for FIGS. 14-16. However, in this embodiment, the mounting peg 30 is attached directly to the spherical head 60 in the mounting port 64. The length of the mounting peg 30 may be increased to account for the absence of the central neck 58 and base 62.

Although several embodiments have been described in detail for purposes of illustration, various modifications may be made without departing from the scope and spirit of the invention. Accordingly, the invention is not to be limited, except as by the appended claims.

What is claimed is:

1. A zero torque riser for an archery bow, comprising:

a riser body having a forward riser beam disposed on an anterior portion of the riser body;

a mounting peg attached to a posterior surface of the forward riser beam;

a hand grip; and a hemispherical pivoting means for attaching the hand grip to the mounting peg, wherein the mounting peg comprises a tapered stem and the hemispherical pivoting means comprises a spherical head having a tapered port received on and securely connected to the tapered stem.

2. The zero torque riser of claim 1, the riser body further comprising an upper riser portion extending above the forward riser beam, an arrow shelf disposed between the forward riser beam and the upper riser portion, a lower riser portion extending below the forward riser beam, and a rear riser beam spanning from the lower riser portion to the upper riser portion.

3. The zero torque riser of claim 2, the riser body further comprising multiple lateral bridge supports spanning from the lower riser portion to the upper riser portion or the arrow shelf.

4. The zero torque riser of claim 2, the riser body further comprising a sight window bridge support spanning from the arrow shelf to an upper end of the upper riser portion.

5. The zero torque riser of claim 1, wherein the spherical head is rotatably mounted in a spherical socket on the hand grip.

6. The zero torque riser of claim 5, wherein the spherical socket is formed by an upper cap and a lower cap surrounding the spherical head within an anterior channel on the hand grip, wherein the upper cap and lower cap are secured within the anterior channel.

7. The zero torque riser of claim 6, further comprising a base plate to which the upper cap and lower cap are securely mounted, wherein the base plate is secured to an anterior surface of the hand grip.

8. A zero torque riser for an archery bow, comprising:

a riser body having a forward riser beam disposed on an anterior portion of the riser body;

a mounting peg attached to a posterior surface of the forward riser beam;

a hand grip; and a hemispherical pivoting means for attaching the hand grip to the mounting peg, wherein the hemispherical pivoting means comprises a pivoting ball mount having an elongated central stem having a spherical head attached to one end and a base attached to an opposite end, wherein the spherical head is rotatably mounted in a spherical socket on the hand grip and the base includes a tapered port configured to receive and securely connect to a tapered stem on the mounting peg.

9. The zero torque riser of claim 8, further comprising a plurality of mounting holes on the forward riser beam, and an adjustable clamp configured to adjustably attach the mounting peg to the forward riser beam by one or more of the plurality of mounting holes.

10. The zero torque riser of claim 9, further comprising vibration padding between the forward riser beam, the mounting peg, and the adjustable clamp.

11. A zero torque riser for an archery bow, comprising:

a riser body having a forward riser beam disposed on an anterior portion of the riser body, wherein the forward riser beam comprises a plurality of mounting holes;

an adjustable clamp configured to adjustably attach to the forward riser beam by one or more of the plurality of mounting holes;

a mounting peg attached to a posterior surface of the forward riser beam by the adjustable clamp;

a hand grip; and a spherical head securely connected to the mounting peg and rotatably mounted in a spherical socket on the hand grip, wherein the hand grip is attached to the mounting peg in a hemispherically pivoting manner.

12. The zero torque riser of claim 11, the riser body further comprising an upper riser portion extending above the forward riser beam, an arrow shelf disposed between the forward riser beam and the upper riser portion, a lower riser portion extending below the forward riser beam, and a rear riser beam spanning from the lower riser portion to the upper riser portion.

13. The zero torque riser of claim 12, the riser body further comprising multiple lateral bridge supports spanning from the lower riser portion to the upper riser portion or the arrow shelf.

14. The zero torque riser of claim 12, the riser body further comprising a sight window bridge support spanning from the arrow shelf to an upper end of the upper riser portion.

15. The zero torque riser of claim 11, wherein the mounting peg has a tapered stem and the spherical head has a tapered port configured to receive and securely connect to the tapered stem.

16. The zero torque riser of claim 11, wherein the spherical socket is formed by an upper cap and a lower cap surrounding the spherical head within an anterior channel on the hand grip, wherein the upper cap and lower cap are secured within the anterior channel.

17. The zero torque riser of claim 16, further comprising a base plate to which the upper cap and lower cap are securely mounted, wherein the base plate is secured to an anterior surface of the hand grip.

18. The zero torque riser of claim 11, further comprising a pivoting ball mount consisting of an elongated central stem having the spherical head attached to one end and a base attached to an opposite end, wherein the base includes a tapered port configured to receive and securely connect to a tapered stem on the mounting peg.

19. The zero torque riser of claim 11, further comprising vibration padding between the forward riser beam, the mounting peg, and the adjustable clamp.

* * * * *